US008056726B2

(12) United States Patent
Huff et al.

(10) Patent No.: US 8,056,726 B2
(45) Date of Patent: Nov. 15, 2011

(54) METHOD AND APPARATUS FOR REPAIRING A SURFACE DEFECT

(75) Inventors: James M. Huff, Beavercreek, OH (US); Mark DeRyke, Miamisburg, OH (US); Kenneth M. Gannon, Kettering, OH (US); Bert A. Nyberg, Dayton, OH (US); Stephen B. Tummino, Marysville, OH (US)

(73) Assignee: CDO Technologies, Inc., Dayton, OH (US)

( * ) Notice: Subject to any disclaimer, the term of this patent is extended or adjusted under 35 U.S.C. 154(b) by 216 days.

(21) Appl. No.: 12/408,301

(22) Filed: Mar. 20, 2009

(65) Prior Publication Data

US 2010/0236951 A1 Sep. 23, 2010

(51) Int. Cl.
*B65D 25/08* (2006.01)

(52) U.S. Cl. ..... 206/568; 206/221; 206/582; 53/443

(58) Field of Classification Search ..... 206/219–222, 206/229, 302, 568, 582; 53/443, 445, 471; 156/94, 97; 427/140
See application file for complete search history.

(56) References Cited

U.S. PATENT DOCUMENTS

| | | | | |
|---|---|---|---|---|
| 2,631,521 | A | 3/1953 | Atkins, Jr. | |
| 2,756,875 | A | 7/1956 | Yochim | |
| 2,916,197 | A | 12/1959 | Detrie et al. | |
| 2,932,385 | A | 4/1960 | Bollmeier et al. | |
| 2,971,850 | A | 2/1961 | Barton | |
| 3,074,544 | A | 1/1963 | Bollmeier et al. | |
| 3,083,821 | A * | 4/1963 | Woodson | 206/568 |
| 3,149,943 | A | 9/1964 | Amador | |
| 3,347,410 | A | 10/1967 | Schwartzman | |
| 3,349,966 | A | 10/1967 | Schwartzman | |
| 3,404,811 | A | 10/1968 | Cernei | |
| 3,443,726 | A | 5/1969 | Muller et al. | |
| 3,548,562 | A | 12/1970 | Schwartzman | |
| 3,608,709 | A | 9/1971 | Pike | |
| 3,610,586 | A | 10/1971 | Price et al. | |
| 3,756,389 | A | 9/1973 | Firth | |
| 3,809,224 | A | 5/1974 | Greenwood | |
| 3,809,289 | A | 5/1974 | Komendowski | |
| 3,950,158 | A | 4/1976 | Gossett | |
| 3,983,994 | A * | 10/1976 | Wyslotsky | 206/219 |
| 4,067,440 | A | 1/1978 | Lataix | |
| 4,177,938 | A | 12/1979 | Brina | |
| 4,211,019 | A * | 7/1980 | McCafferty | 206/219 |
| 4,244,467 | A | 1/1981 | Cavazza | |
| 4,271,982 | A | 6/1981 | Niksich et al. | |
| 4,462,224 | A | 7/1984 | Dunshee et al. | |
| 4,519,499 | A | 5/1985 | Stone et al. | |
| 4,557,377 | A | 12/1985 | Maloney | |
| 4,638,927 | A | 1/1987 | Morane | |
| 4,682,689 | A | 7/1987 | Pereira et al. | |
| 4,693,366 | A | 9/1987 | Goncalves | |
| 4,785,931 | A | 11/1988 | Weir et al. | |
| 4,808,006 | A | 2/1989 | Kaufeler | |
| 4,823,946 | A | 4/1989 | Stoeffler et al. | |
| 4,846,585 | A | 7/1989 | Boeckmann et al. | |
| 4,856,651 | A | 8/1989 | Francis, Jr. | |

(Continued)

*Primary Examiner* — Luan K Bui
(74) *Attorney, Agent, or Firm* — Thomas E. Lees, LLC

(57) ABSTRACT

A repair kit (10) includes a sealed package (12) having a plurality of isolated compartments (32, 42, 44) for holding substances (50, 52) that, when mixed together, form an adhesive, and for holding a flexible substrate (54). Pull tabs (60, 66, 80, 86) are arranged on the package (12) to aid in opening fluid communication between the compartments to permit adhesive mixture and to permit adhesive flow onto the substrate (54) for subsequent repair purposes.

22 Claims, 6 Drawing Sheets

U.S. PATENT DOCUMENTS

| | | | | | |
|---|---|---|---|---|---|
| 4,872,556 | A | | 10/1989 | Farmer | |
| 4,936,445 | A | | 6/1990 | Grabenkort | |
| 4,961,495 | A | | 10/1990 | Yoshida et al. | |
| 4,997,083 | A | * | 3/1991 | Loretti et al. | 206/219 |
| 5,069,773 | A | * | 12/1991 | Frangioni | 206/449 |
| 5,071,034 | A | | 12/1991 | Corbiere | |
| 5,152,965 | A | | 10/1992 | Fisk et al. | |
| 5,277,303 | A | | 1/1994 | Goyet et al. | |
| 5,287,961 | A | | 2/1994 | Herran | |
| 5,333,737 | A | | 8/1994 | Clark | |
| 5,353,927 | A | | 10/1994 | Stupar et al. | |
| 5,405,051 | A | | 4/1995 | Miskell | |
| 5,411,295 | A | | 5/1995 | Bates et al. | |
| 5,492,219 | A | | 2/1996 | Stupar | |
| 5,494,190 | A | | 2/1996 | Boettcher | |
| 5,514,394 | A | | 5/1996 | Lenahan | |
| 5,647,481 | A | | 7/1997 | Hundertmark et al. | |
| 5,699,902 | A | * | 12/1997 | Sperry et al. | 206/219 |
| 5,714,208 | A | * | 2/1998 | Ferrell et al. | 206/229 |
| 5,884,759 | A | | 3/1999 | Gueret | |
| 5,890,596 | A | | 4/1999 | Albisetti | |
| 5,954,230 | A | | 9/1999 | Blette et al. | |
| 6,165,161 | A | * | 12/2000 | York et al. | 604/408 |
| 6,893,696 | B2 | | 5/2005 | Hansen et al. | |
| 7,243,788 | B2 | * | 7/2007 | Schmidt et al. | 206/221 |
| 7,377,383 | B2 | | 5/2008 | Henry | |
| 2002/0066678 | A1 | * | 6/2002 | Sharon et al. | 206/219 |
| 2007/0114145 | A1 | * | 5/2007 | Wallace | 206/219 |

* cited by examiner

METHOD AND APPARATUS FOR REPAIRING A SURFACE DEFECT

FIELD OF THE INVENTION

The present invention is directed to a method and apparatus for repairing a surface defect and is more particularly directed to a method and apparatus for repairing a surface defect that would be self contained within a repair kit package.

BACKGROUND

Many items become damaged due to unexpected accidents or corrosion. For example, vehicles, boats, surf boards, etc., may become damaged through use wherein the surface of the object is dented or punctured. One way to repair such damage in these objects is to mix together epoxy which is a two part chemical comprising a resin and a catalyst. Once these two materials are mixed together they form an adhesive which is then paddled into the dent. The material is smoothed with the paddle and the material allowed to dry. The hardened material is then sanded smooth and finished such as by painting. During the repair, the user is in contact with the epoxy material during mixing and during application using the paddle.

Sometimes, a repair of an object requires the use of a supporting material such as volan or fiberglass cloth. For such repairs, the epoxy mixture is spread over the dent and the volan cloth is placed over the epoxy covering the dent. More epoxy is then spread over the volan cloth. However, it is difficult to keep the volan cloth from moving when the epoxy is being spread over the volan cloth. The material is then smoothed, allowed to dry, sanded, and finished.

SUMMARY OF THE INVENTION

In accordance with one aspect of the present invention, a repair kit includes a sealed package having a plurality of isolated compartments for holding substances that, when mixed together, form an adhesive, and for holding a flexible substrate. Pull tabs are arranged on the package to aid in opening fluid communication between the compartments to allow for adhesive mixture and to allow for adhesive flow onto the substrate for subsequent repair purposes.

In accordance with one example embodiment of the present invention, a repair kit is provided comprising a sealed package having a plurality of isolated compartments, at least two of the plurality of isolated compartments holding substances that, when mixed together, form an adhesive, and a third of the plurality of isolated compartments holding a flexible substrate. A plurality of pull tabs are arranged on an outside of the package so that when the pull tabs are pulled, they open fluid communication between the compartments. Certain of the pull tabs, when pulled, allow the plurality of substances to be mixed to form the adhesive. Certain others of the pull tabs, when pulled, allow the adhesive to cover the substrate for a subsequent repair purposes.

In accordance with another example embodiment of the present invention an apparatus for is provided making a repair comprising a sealed package having a plurality of isolated compartments including, a first compartment for storing a resin, and a second compartment for storing a catalyzing agent, the resin and the catalyzing agent, when mixed together, forming an adhesive, and a third compartment for storing a flexible substrate. Separable isolation seals are located between the first and second compartments and are also located between the first, second, and the third compartments to keep the three compartments isolated from each other. A plurality of pull tabs are located on opposite sides of the package and positioned so that pulling of selected pull tabs permits fluid communication between the first and second compartments and allows mixing of the resin and the catalyzing agent so as to form the adhesive. Pulling of other selected tabs permits fluid communication of the adhesive with the flexible substrate to allow the substrate to be covered with the adhesive.

In accordance with yet another example embodiment of the present invention a repair kit for making a fiberglass patch repair is provided comprising a flexible package having a plurality of isolated compartments, one compartment holding a resin, one compartment holding a catalyzing agent, and one compartment holding a fiberglass cloth material. A first pull tab arrangement is mounted between the compartments having the resin and the catalyzing agent so that applied force to the first pull tab arrangement permits fluid communication therebetween and allows the resin and catalyzing agents to be mixed. A second pull tab structure is mounted between at least one of the compartments having the resin and the catalyzing agent and the compartment holding the fiberglass cloth material so that applied force to the second pull tab arrangement permits fluid communication with the mixture and the fiberglass cloth.

In accordance with another example embodiment of the present invention, a method is provided for making a repair kit comprising the steps of sealing a two layer package so that the package has a plurality of isolated compartments, storing a resin material in a first compartment of the package, storing a catalyzing agent in a second compartment of the package, storing a flexible substrate in a third compartment of the package, and applying pull tabs to the package at locations so that when the pull tabs are pulled, fluid communication between the selected compartments is enabled.

In accordance with another example embodiment of the present invention, a method is provided for making a repair comprising the steps of using a package having a plurality isolated compartments for storing a resin material in a first compartment of the package, for storing a catalyzing agent in a second compartment of the package, and for storing a flexible substrate in a third compartment of the package. The method further including the steps of pulling tabs on the package to permit the resin material and catalyzing agent to be mixed together, mixing the resin material and the catalyzing agent together to form an adhesive, pulling tabs on the package to permit the adhesive to flow into the compartment having the flexible substrate, moving the adhesive to cover the flexible substrate, opening the package, and placing the adhesive covered substrate against an object to be repaired.

BRIEF DESCRIPTION OF THE DRAWINGS

The foregoing and other features and advantages of the present invention will become apparent to those skilled in the art to which the present invention relates upon reading the following description with reference to the accompanying drawings, in which.

DETAILED DESCRIPTION

Figure 1:
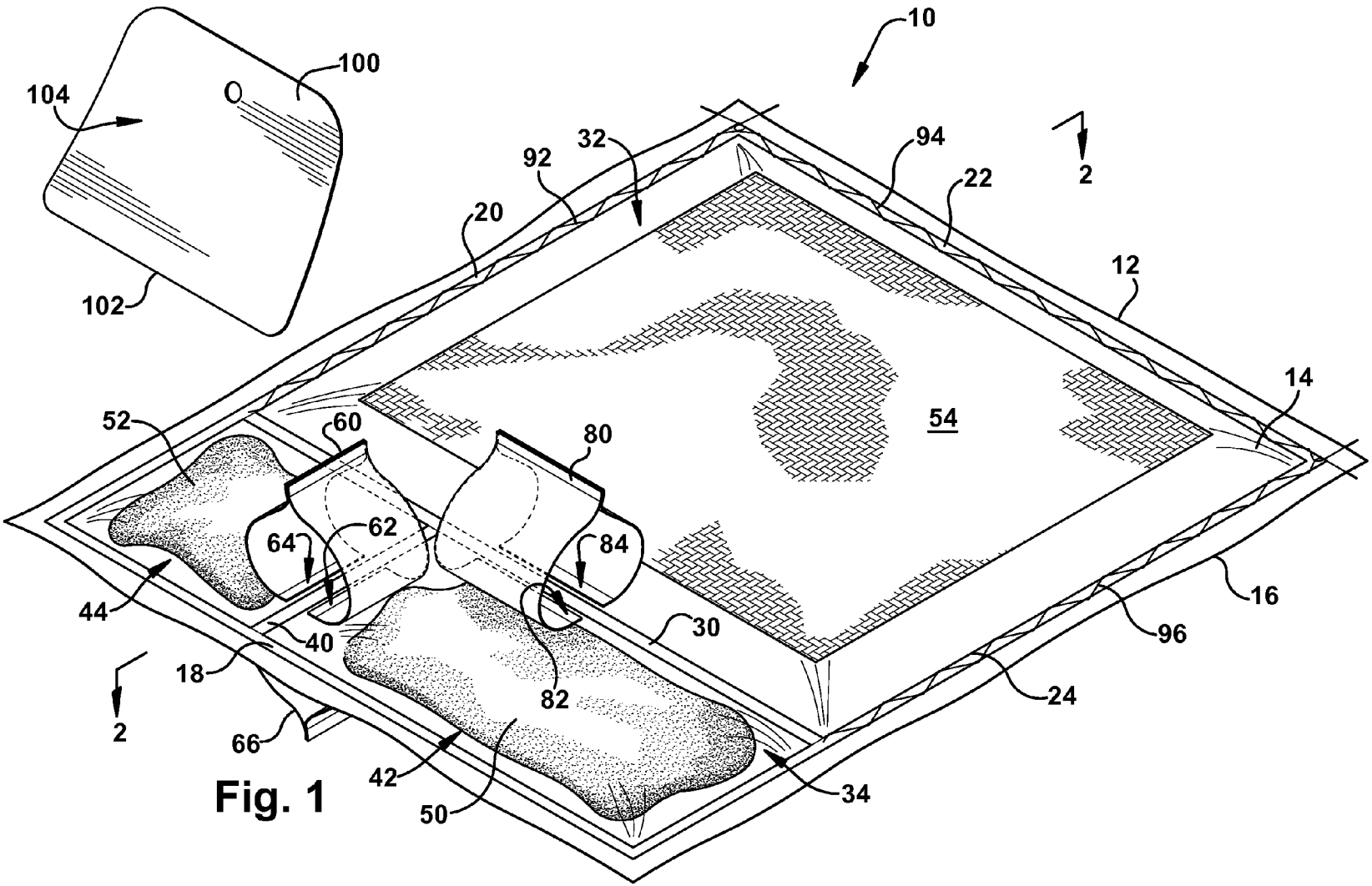
FIG. 1 is a perspective view of a repair kit made in accordance with one example embodiment of the present invention.
Figure 2:
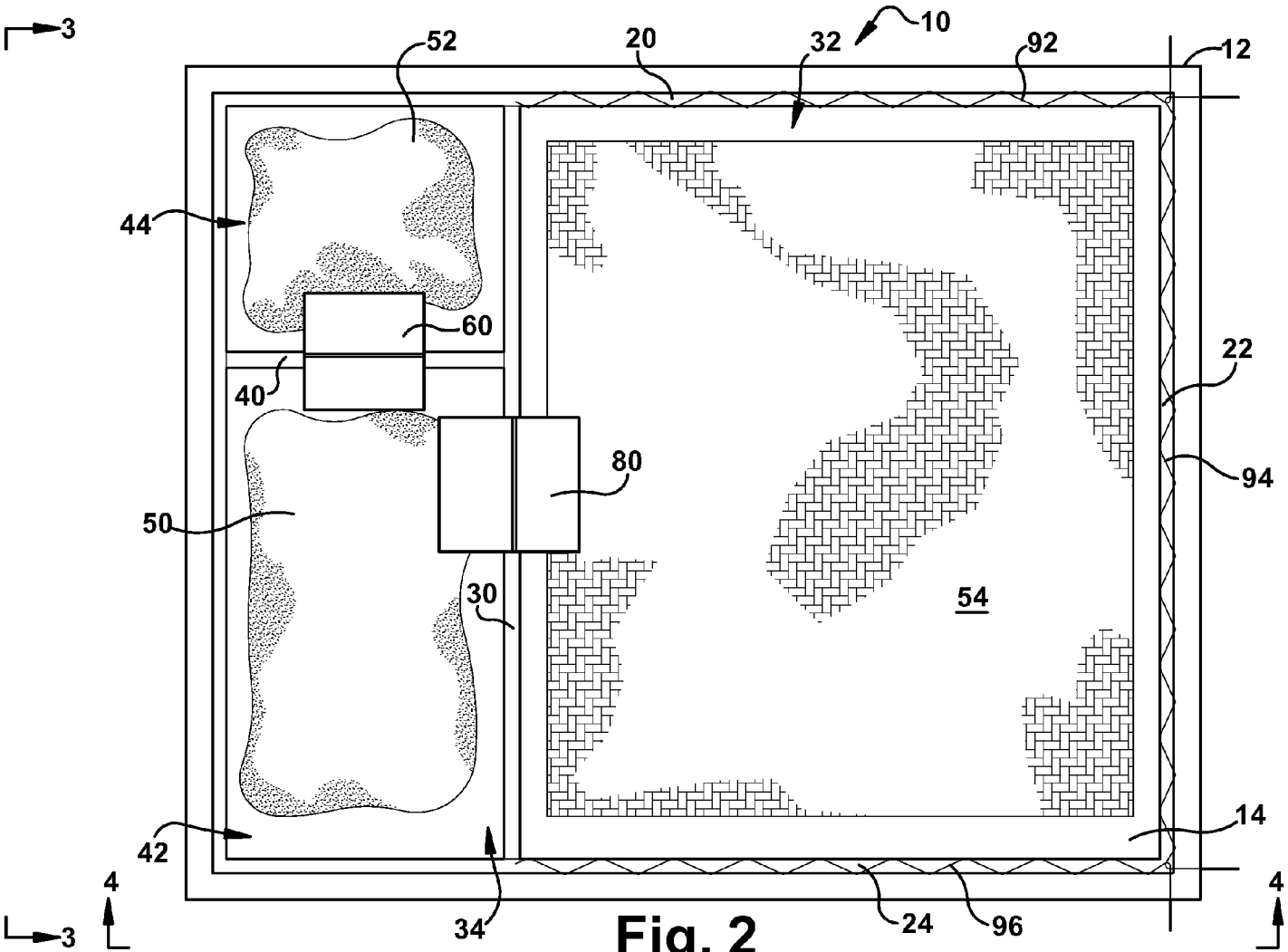
FIG. 2 is a top view of the repair kit of FIG. 1.
Figure 3:
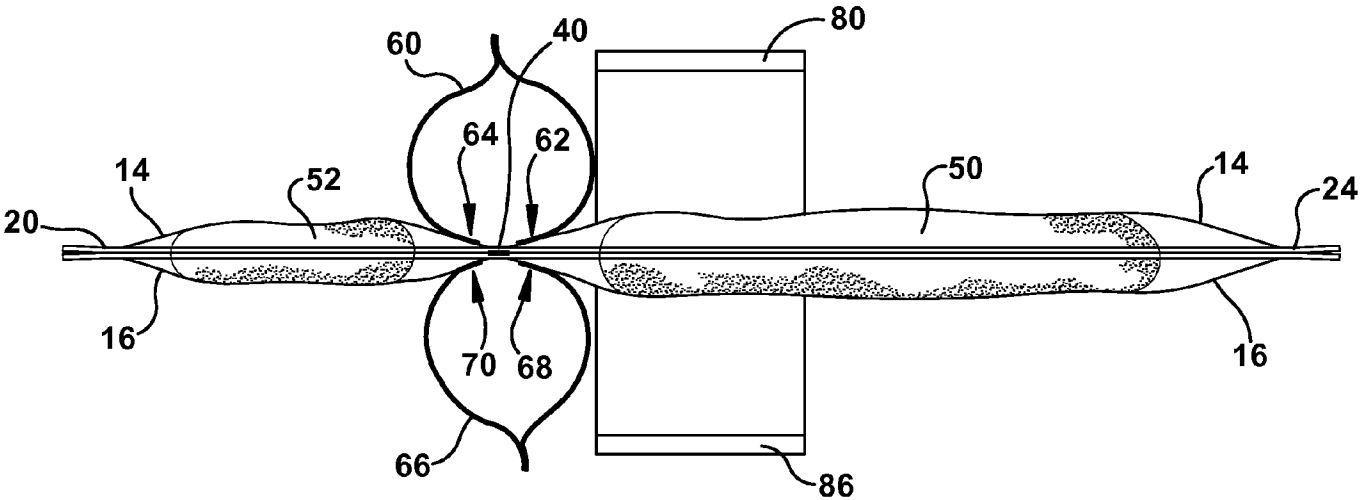
FIG. 3 is side sectional view taken along lines 3-3 of FIG. 2.
Figure 4:
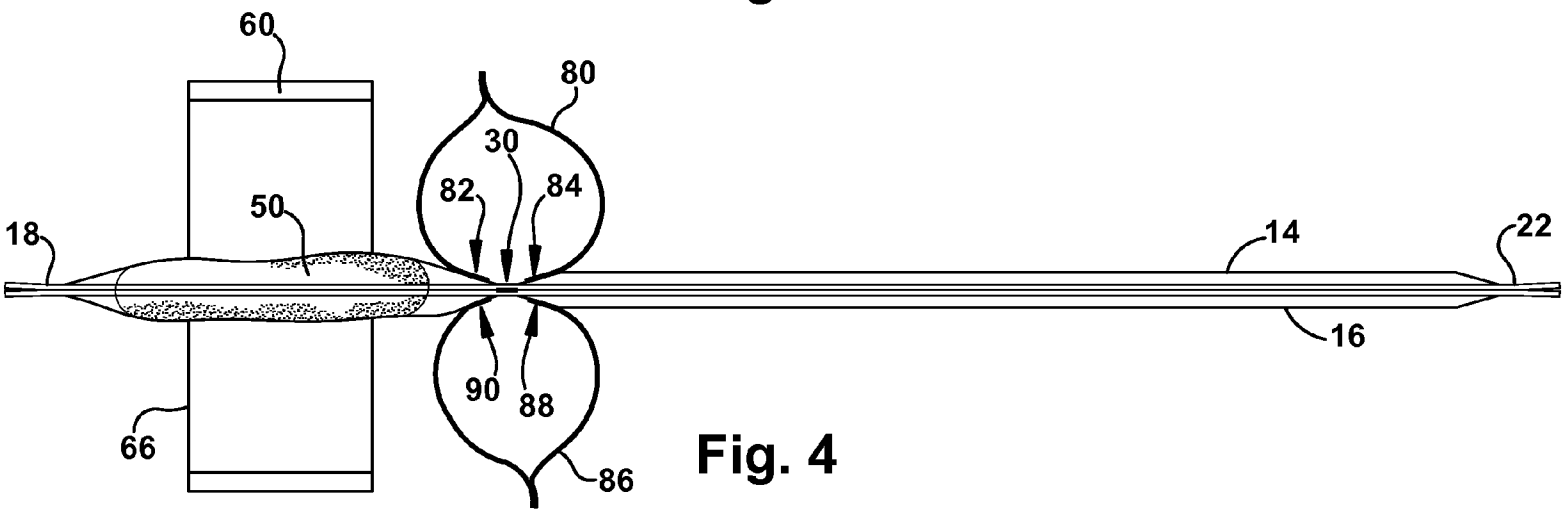
FIG. 4 is side sectional view taken along lines 4-4 of FIG. 2.

Referring to FIGS. 1-4, a surface repair kit 10, made in accordance with one example embodiment of the present invention, is shown. The surface repair kit 10 includes a multi-compartment package 12 made from a two flexible, spaced apart sheets 14, 16 of plastic. The plastic sheets 14, 16 can be made from various plastic materials such as polyvinyl chloride ("PCV") or polyvinyl alcohol ("PVA"). The package 12 is formed by heat sealing the outer peripheral edges 18, 20, 22, 24 of the two sheets 14, 16. The heat sealing of the package 12 is accomplished by applying pressure in combination with heat. For example, applying a heat of 127 degrees Fahrenheit at a pressure of 5-7 psi will seal the two sheets 14, 16 of PVA together. By heat sealing the package 12 around the entire outer peripheral edge, one large compartment is formed.

The flexible package 12 is then divided into a plurality of individual compartments to maintain elements that make up the repair kit 10 isolated from each other until ready for use. Specifically, a heat seal 30 extends from the heat seal 20 to the heat seal 24 and divides the package 12 into two compartments 32, 34. A second heat seal 40 extends from the heat seal 18 to the heat seal 30 so as to divide the compartment 34 into two compartments 42, 44. The result of the two heat seals 30 and 40 results in a three compartment flexible package 12. These three compartments are fluid tight and fluid isolated from each other.

In accordance with one example embodiment of the present invention, the first compartment 42 stores a premeasured amount of a liquid epoxy resin 50. Stored in the second compartment 44 is a premeasured amount of a liquid catalyzing agent 52. Stored in the compartment 32 is a fiber reinforced material 54 such as volan or fiberglass cloth. The size and shape of the material 54 may be varied in accordance with the size and shape of the repair desired. For example, if a small round hole is to be patched, the material 54 can be sized so as to be small and round and the amount of epoxy resin 50 and catalyzing agent 52 would commensurately be adapted, i.e., the entire kit 10 (package 12) size would be adjusted accordingly. If the repair is for a large rectangular or triangular shaped, the size of the kit 10 (package 12) could be adapted to have a similarly shaped material 54 with a commensurate amount of resin 50 and catalyzing agent 52. The amount of the epoxy resin 50 and catalyzing agent 52 are selected so as to properly mix together to form a good adhesive and to result in an adequate amount to fully cover and impregnate the fiberglass cloth 54 of the kit 10.

The heat seals 18, 20, 22, 24, and 30, and 40 keep the three kit materials, i.e., epoxy resin 50, catalyzing agent 52 and fiberglass cloth 54, isolated from each other and within the package 12 until the kit 10 is ready for use.

The package 10 further includes a first pull tab 60 located on side 14 of the package 12 and connected at locations 62, 64 to compartments 42, 44, respectively, adjacent to but slightly spaced from the heat seal 40. A second pull tab 66 is located on side 16 of the package 12 and connected to locations 68, 70 on compartment 42, 44, respectively, adjacent to but slightly spaced from the seal 40 and approximately opposite from where the pull tab 60 is located.

A third pull tab 80 is located on side 14 of the package 12 and connected at locations 82, 84 to the compartments 42, 32, respectively, adjacent to but slightly spaced from the heat seal 40. A fourth pull tab 86 is located on side 16 of the package 12 and connected at locations 88, 90 to the compartment 42, 32, respectively, adjacent to but slightly spaced from the heat seal 40 and approximately opposite from where the pull tab 80 is located. Each of the pull tabs 60, 66, 80, 86 forms a loop large enough to accept a finger of the user of the repair kit 10.

Within the heat seals 20, 22, 24, as they define three sides of the compartment 32 holding the fiberglass material 54, are rip strings 92, 94, 96, respectively. The rip strings are positioned between the layers 14, 16 when the heat seals 20, 22, 24 are formed so that the strings become embedded within the seal. When it is desired to access the fiberglass material and open the compartment 32, the strings 92, 94, 96 are pulled and rip open their associated heat seal thereby permitting separation of the layers 14, 16.

The repair kit 10 further includes a paddle 100 having a flat working surface 102 and a concave area that is useful for finger placement by the kit user. The paddle 100 could be made from a semi-rigid plastic.

Figure 5:
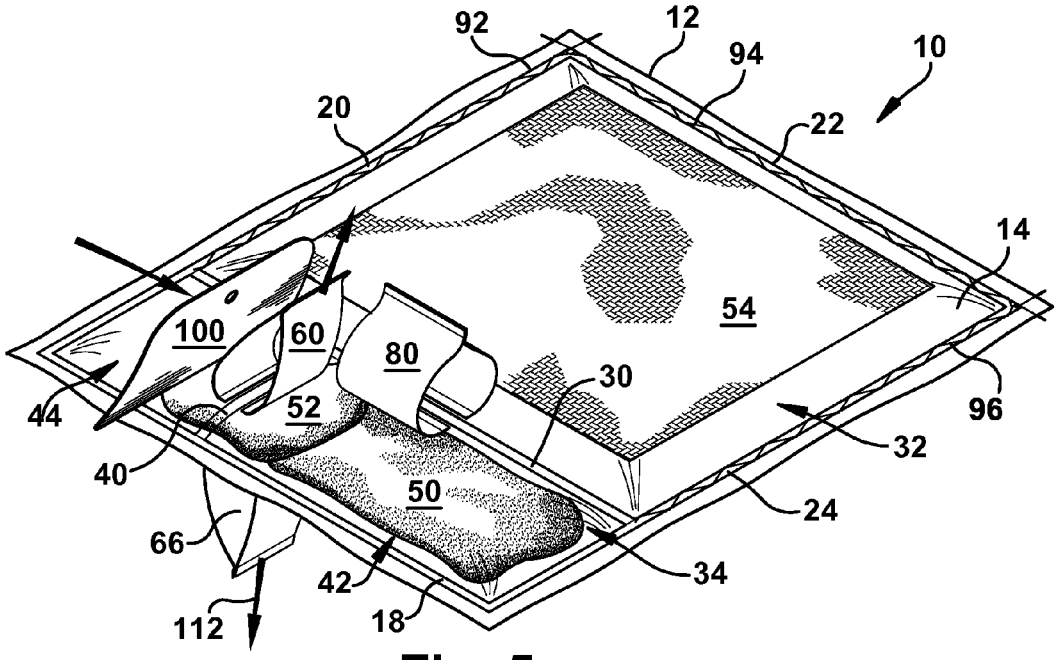
FIG. 5 is a perspective view of the repair kit of FIG. 1 showing two compartments in fluid communication for mixing an adhesive.
Figure 6:
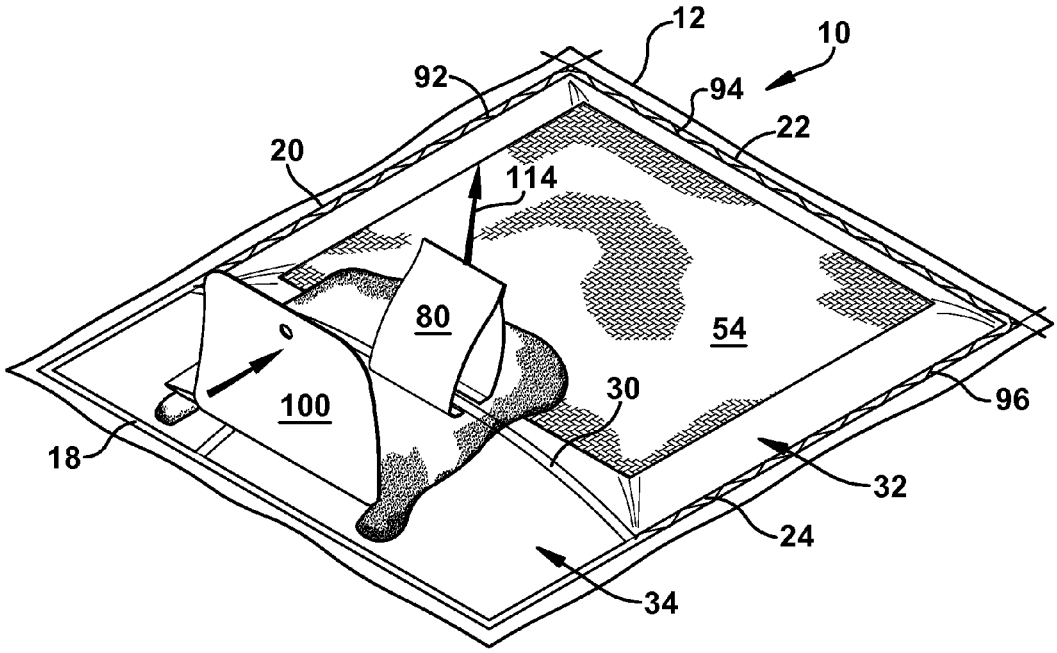
FIG. 6 is a perspective view of the repair kit of FIG. 1 showing two compartments in fluid communication for moving mixed adhesive onto a flexible substrate.
Figure 7:
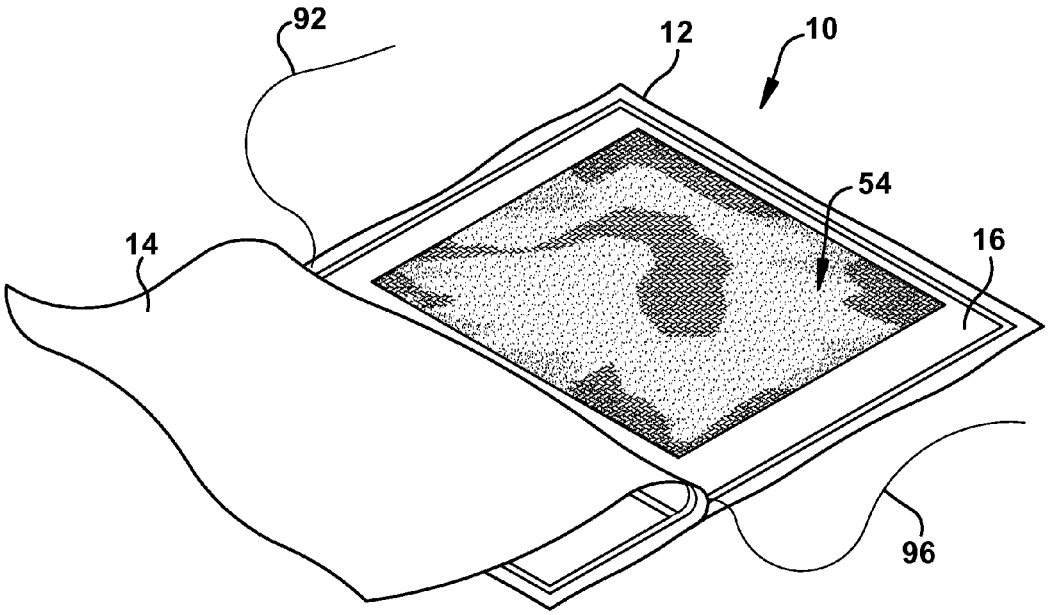
FIG. 7 is a perspective view of the repair kit of FIG. 1 showing opening of the compartment having the flexible substrate.

When it is desired to use the kit 10 to make a repair, the user must first mix the epoxy resin 50 with the catalyzing agent 52. Referring to FIGS. 5-7, the user of the kit 10 inserts his fingers into the loops of tabs 60 and 66 and gently pulls in opposite directions as indicated by arrows 110, 112. Alternatively, rather than inserting a finer into each of the loops, the taps 60, 66 could just be grabbed and pulled apart in the direction of arrows 110, 112. Sufficient force is applied until the heat seal 40 is torn open allowing fluid communication between compartments 42 and 44 so that the epoxy resin 50 can be mixed with the catalyzing agent 52. The two chemicals can be mixed together by the user applying hand kneading force back-and-forth between the two compartments with his hands or the paddle 100 can be used in a back-and-forth motion across the two compartments until a good mixture of the resin 50 and catalyzing agent 52 is achieve thereby forming a good adhesive.

Once the good adhesive is mixed, the user applies an equal and opposite force to the taps 80 in the direction of arrow 114 and 86 in the 15 opposite direction by either grabbing the associated tabs or by placing associated fingers in the tab loops. A sufficient gentle force is applied to tear open the heat seal 30 and thereby permit fluid communication between the compartment 34 and the compartment 32. The adhesive mix is then squeegeed into the compartment 32 so as to cover and impregnate 20 the fiberglass cloth 54. The paddle 100 aids in moving the adhesive mix in the process as shown in FIG. 6.

Once the fiberglass cloth 54 is fully covered and ready to be applied to the surface to be repaired, the strings 92, 94, and 96 are pulled so as to break the heat seals 20, 22, 24. The one layer 14 can then be peeled back to expose the impregnated fiberglass cloth 54. The kit 10 is picked-up from the back side touching the layer 16, the fiberglass cloth is placed against the surface to be repaired, and then the layer 16 of the package 12 is peeled away. The fiberglass cloth 54 is then allowed to dry on the object being repaired and hardened for later finishing of the repair. The kit 10 can then be properly disposed of without the user ever coming in contact with any of the materials.

Figure 8:
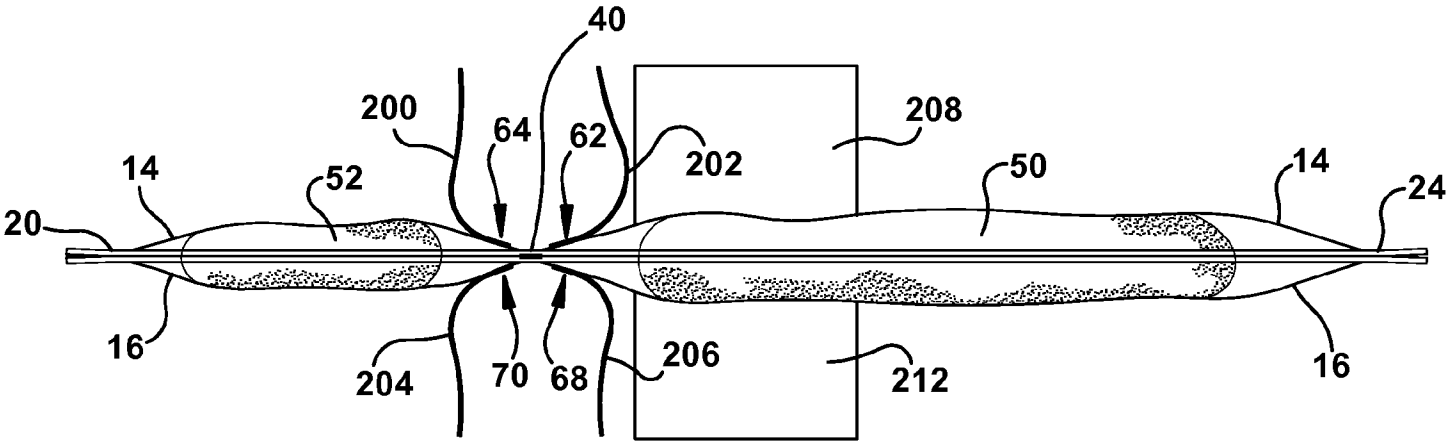
FIG. 8 is side sectional view similar to FIG. 3 of an alternative embodiment of the present invention.
Figure 9:
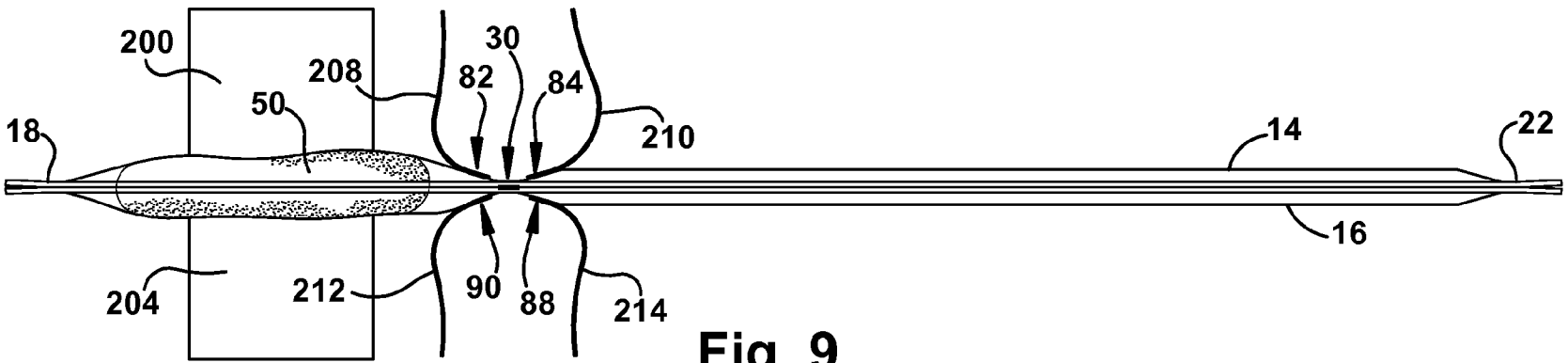
FIG. 9 is side sectional view similar to FIG. 4 of an alternative embodiment of the present invention.

Referring to FIGS. 8 and 9, an alternative embodiment of the present invention is shown. Rather than pull tabs 60, 66, 80, 86 formed into loops as described above, individual pull tabs 200, 202, 204, 206, 208, 210, 212, and 214 are secured to the package 12 at appropriate locations spaced away from the heat seals in a similar manner as described above. These individual pull tabs can be held between individual fingers for pulling. Those skilled in the art will also appreciate that in accordance with another possible embodiment, it is possible to have individual combinations of pull tabs such as (200 and 206) OR (200 and 204) OR (202 and 204) OR (202 and 206) to pull heat seal 40 apart. Similarly, it is possible to have individual combinations of (208 and 214) OR (210 and 212) OR (208 and 212) OR (210 and 214) to be used to pull heat seal 30 apart. These alternatives would reduce the number of pull tabs required.

From the above description of the invention, those skilled in the art will perceive improvements, changes and modifications. Such improvements, changes and modifications within the skill of the art are intended to be covered by the appended claims.

Having described the invention, the following is claimed:

1. A repair kit comprising:

a sealed package having a plurality of isolated compartments, at least two of the plurality of compartments holding substances that, when mixed together, form an adhesive, and a third of the plurality of compartments holding a cloth substrate; and pull tabs are arranged on an outside of the package so that when the pull tabs are pulled, they permit direct fluid communication between the compartments, certain of said pull tabs, when pulled, permit the substances to be mixed within the sealed package and form the adhesive and certain other of said pull tabs, when pulled, permit the adhesive to cover the substrate without exposing the adhesive to the environment outside the sealed package.

2. The repair kit of claim 1 further including a string embedded in a heat sealed edge of the package to permit a portion of the sealed package to be peeled away and permit access to the adhesive covered substrate.

3. The repair kit of claim 1 wherein each of the plurality of pull tabs includes a loop structure arranged to accept a user's finger.

4. The repair kit of claim 1 wherein the package comprises two spaced apart layers of polyvinyl alcohol and the compartments are separated by heat sealed sections of the layers.

5. The repair kit apparatus of claim 4 wherein the plurality of pull tabs each includes a loop connected to the package at a location spaced away from a heat seal divides that form the compartments.

6. The repair kit of claim 1 further including a paddle to aid in mixing the adhesive and moving the adhesive to cover the substrate.

7. The repair kit of claim 1 wherein the package is made from spaced apart layers of polyvinyl chloride.

8. The repair kit of claim 2 wherein access permitted to the adhesive covered substrate is access without a user coming into contact with the substrate.

9. An apparatus for making a repair comprising:

a sealed package having a plurality of isolated compartments including, a first compartment for storing a resin, a second compartment for storing a catalyzing agent, the resin and the catalyzing agent, when mixed together, forming an adhesive, and a third compartment for storing a flexible substrate;

separable isolation seals located between the first and the second compartments and also located between the first, the second, and the third compartments to keep the three compartments isolated from each other;

a plurality of pull tabs located on opposite sides of the package and positioned so that pulling of selected pull tabs permits fluid communication between the first and the second compartments and permits mixing of the resin and the catalyzing agent so as to form the adhesive, and pulling of other selected tabs allows fluid communication of the adhesive with the flexible substrate to permit the substrate to be covered with the adhesive; and a string embedded in a heat sealed edge of the sealed package to open the sides of the sealed package, permit a portion of the package to be peeled away, and permit access to the adhesive covered substrate.

10. The apparatus of claim 9 wherein each of the plurality of pull tabs includes a loop structure arranged to accept a user's finger.

11. The apparatus of claim 9 wherein the package is made from two spaced apart layers of polyvinyl alcohol and the compartments are formed by heat sealing the layers together.

12. The apparatus of claim 11 wherein the plurality of pull tabs each includes a loop connected to the package at a location spaced away from a heat seal divides that form the compartments.

13. The apparatus of claim 9 wherein the package is made from spaced apart layers of polyvinyl chloride.

14. A repair kit for making a fiberglass patch repair comprising:

a flexible package having a plurality of isolated compartments, one compartment holding a resin, one compartment holding a catalyzing agent, and one compartment holding a fiberglass cloth material;

a first pull tab arrangement mounted between the compartments having the resin and the catalyzing agent so that applied force to the first pull tab arrangement permits fluid communication therebetween and permits the resin and catalyzing agents to be mixed within the package; and a second pull tab structure mounted between at least one of the compartments having the resin and the catalyzing agent and the compartment holding the fiberglass cloth material so that applied force to the second pull tab arrangement permits fluid communication with the mixture and the fiberglass cloth without exposing the adhesive to the environment outside the package.

15. The repair kit of claim 14 further including a string embedded in a heat sealed edge of the package to permit a portion of the sealed package to be peeled away and permit access to the adhesive covered substrate.

16. The repair kit of claim 14 wherein the first pull tab arrangement includes a loop structure arranged to accept a user's finger.

17. A method for making a repair kit comprising the steps of:

sealing a two layer package so that the package has a plurality of isolated compartments;

storing a resin material in a first compartment of the package;

storing a catalyzing agent in a second compartment of the package;

storing a cloth substrate in a third compartment of the package; and applying pull tabs to the package at locations so that when the pull tabs are pulled, direct fluid communication between the compartments is enabled to permit the resin material and catalyzing agent to be mixed within the sealed package to form an adhesive and to permit the adhesive to cover the cloth substrate without exposing the adhesive to the environment outside the sealed package.

18. The method of claim 17 further comprising the steps of making the package using two spaced apart layers of polyvinyl alcohol and forming the compartments heat sealing the layers together.

19. The method of claim 18 further including the steps of forming the pull tabs into loops and connecting them to the package at locations spaced away from a heat seal divides that form the compartments.

20. The method of claim 18 further including the steps of embedding a string into the heat sealed edges of the package during manufacture to allow access to the flexible substrate by pulling of the string and tearing open of the heat sealed edges.

21. A method for making a repair comprising the steps of:

using a sealed package having a plurality isolated compartments;

storing a resin material in a first compartment of the package, a catalyzing agent in a second compartment of the package, and a cloth substrate in a third compartment of the package;

pulling tabs on the package to permit the resin material and catalyzing agent to be mixed together within the sealed package;

mixing the resin material and the catalyzing agent together to form an adhesive;

pulling tabs on the sealed package to permit the adhesive to flow into the compartment having the cloth substrate;

moving the adhesive to cover the flexible substrate without exposing the adhesive to the environment outside the sealed package;

opening the package; and placing the adhesive covered substrate against an object to be repaired.

22. The method of claim 21 wherein placing the adhesive covered substrate against an object to be repaired includes placing the adhesive covered substrate against the object without a user coming into contact with the substrate.

* * * * *